United States Patent [19]

Rogers

[11] 4,286,741

[45] Sep. 1, 1981

[54] HANDGUN HOLSTER

[75] Inventor: William H. Rogers, Jacksonville, Fla.

[73] Assignee: Alpha Plastics, Inc., Jacksonville, Fla.

[21] Appl. No.: 954,351

[22] Filed: Oct. 25, 1978

[51] Int. Cl.[3] ..... F41B 13/04

[52] U.S. Cl. ..... 224/193; 224/238; 224/243; 224/911

[58] Field of Search ..... 224/198, 199, 206, 185, 224/193, 242, 232, 234, 236, 238, 240, 243, 245, 247, 250, 255, 256, 911, 912, 913, 914, 908, 909, 191, 192, 196; 24/73 FA, 205.17, 205.18, 208 R, 223; 150/43, 52, 7; 2/251, 252, 247

[56] References Cited

U.S. PATENT DOCUMENTS

| | | | |
|---|---|---|---|
| 685,952 | 11/1901 | Sullivan | 150/42 UX |
| 1,368,878 | 2/1921 | Bandell | 24/208 R UX |
| 2,001,321 | 5/1935 | Berns | 224/911 X |
| 2,051,844 | 8/1936 | Green | 224/243 |
| 2,765,107 | 10/1956 | Browning | 224/912 X |
| 3,531,031 | 9/1970 | Angell | 224/238 |
| 3,804,306 | 4/1974 | Azurin | 224/911 X |
| 3,865,289 | 2/1975 | Boren | 224/243 X |
| 3,902,639 | 9/1975 | Rogers | 224/243 X |
| 4,079,870 | 3/1978 | Clark | 224/246 |

*Primary Examiner*—Robert J. Spar
*Assistant Examiner*—Edward M. Wacyra
*Attorney, Agent, or Firm*—Arthur G. Yeager

[57] ABSTRACT

A plastic clamshell holster comprising an elongated strap connected to the outer sidewall, spanning the upper end of a forward slot and including an end portion having a snap element adapted to engage a snap element on the inner sidewall adjacent the slot. A flap having a manually engageable tab for moving the flap outwardly of the holster is connected to the inner sidewall, biased inwardly adjacent the slot and includes an opening permitting the snap elements to interengage when the flap is positioned between the inner sidewall and the strap end portion. An elongated brace element located between rear portions of the sidewalls includes a stop portion for engaging a rear portion of a handgun trigger guard and a muzzle lock having an end portion for extending into a handgun muzzle. The holster is supported outwardly of the wearer by a mounting bracket which defines a clearing space therebetween permitting the flap to be moved away from the inner sidewall.

12 Claims, 11 Drawing Figures

HANDGUN HOLSTER

BACKGROUND OF THE INVENTION

1. Field of the Invention

This invention generally relates to handgun holsters and more particularly concerns a front opening holster with a selectively positionable retaining feature. In one selected position the retaining feature securely positions a handgun therein while permitting the rapid withdrawal thereof when required, whereas in another selected position the retaining feature, while not permitting as rapid a withdrawal as in the first instance, makes the handgun virtually unobtainable by an assailant or one other than the wearer.

2. Prior Art

Among various law enforcement personnel there has been a demand for a handgun holster which permits the rapid withdrawal of the handgun when required and includes positionable handgun retaining features adaptable for different conditions of use. For example, during normal patrolling duty it is desirable that the handgun retaining features permit the handgun to be rapidly withdrawn from the holster. However, under some conditions, such as crowd control, prisoner escourt, civil disobedience arrests and riot conditions, a relatively greater emphasis is directed to securely retaining the handgun in the holster and relatively less emphasis is concerned with the rapid withdrawal of the handgun from the holster. Accordingly, although restraining features such as straps, flaps and mechanical devices have been employed to prevent inadvertent removal of a handgun, the speed with which such handgun may be withdrawn from the holster may be critical to its effective use and, thus, such restraining features may inhibit effective employment of the handgun and endanger the safety of the user. For example, restraining means such as snaps and flaps often include fastening means attached thereto and engageable with cooperating elements carried by and positioned on the holster body such that the user must, for example, employ an inefficient arm motion, while employing one or more hands, to disengage the strap or flap and subsequently withdraw the handgun. When such fastening means are awkwardly positioned on the holster, a further disadvantage resides in the fact that the hands of the wearer may miss the strap or flap when complicated or awkward arm motions are required for withdrawal of the handgun. Accordingly, it is desirable for the intended wearer of the holster to be able to disengage any and all safety straps while his hand is positioned securely on the handgun or adjacent thereto for immediate withdrawal and use.

An additional desirable holster feature is the provision of retaining means which not only permits the wearer to rapidly withdraw a handgun but also precludes unwanted removal of the handgun by another, such as an unseen assailant who approaches from behind and attempts to grap or pull the weapon from the holster.

Another disadvantage of prior handgun holsters especially those constructed of leather or similar stiff but yieldable material, is that, with continued use, various portions may stretch or deform to the extent that the handgun becomes loosely retained therein, even when various retaining means such as strap, flaps and friction devices are employed with the holster. Although some holsters employ adjustable tightening means to adjust the frictional clamping force exerted on the handgun by the holster, an increase of the tightening force to compensate for a loosening of the holster due to such stretching may result in an uneven constraint of the handgun and a resulting irregular mode of withdrawal. Accordingly, it would be preferable not only to form a holster which is not generally subject to stretching but also to provide a brace means for supporting a handgun in a relatively fixed position in the holster, irrespective of the clamping forces exerted on the handgun.

Holsters which employ restraining straps to retain a handgun in its associated holster are generally exemplified by U.S. Pat. Nos. 2,546,774, 3,630,420, 3,904,091 and 4,079,870. Additionally holsters which employ other retaining means are embodied in U.S. Pat. Nos. 2,051,844, 3,252,639 and 3,699,325 and forward slotted holsters are generally disclosed by U.S. Pat. Nos. 2,001,321 and 3,630,420. Applicant's own U.S. Pat. No. 3,902,639 generally discloses a plastic clamshell holster having a forward slot, recessed gun receiving portions, a rear trigger guard stop and tension adjusting means. However, although many of the above enumerated patents, including applicant's aforementioned patent, provide a means by which the handgun cannot be removed in a direct upward direction, none are designed to include the additional features of a selectively positionable handgun retaining means and a handgun brace means including a muzzle engaging portion.

Therefore, a handgun holster constructed according to the present invention provides an improved holster over applicant's own prior holster and is designed to overcome various problems, such as restraining devices which make a fast withdrawal of a handgun extremely difficult and which may be encountered with some of the prior art. Further, a unitary brace element will be provided which not only supports the handgun within its associated holster but also coacts with restraining strap means to prevent inadvertent removal of the handgun from the holster.

SUMMARY OF THE INVENTION

Accordingly, a general aspect of this invention relates to a handgun holster comprising a body including spaced first and second sidewalls defining an opening therebetween, an elongated element spanning the opening and including one end portion connected to the first sidewall and an opposite second end portion carrying a snap member adapted to cooperatively interengage a snap means fixed to the second sidewall. Operating means including a mounting member or flap is swingably or movably mounted to the second sidewall and includes a finger portion disposed adjacent the snap means wherein the element second end portion is selectively disposable so as to be on respective opposite sides of the finger portion when the element spans the opening and is disposed to engage its snap member with the snap means. When the element is positioned between the second sidewall and the mounting member, the mounting member is moved away from the sidewall to permit removal of the element positioned therebetween and, conversely, when the element is engaged with the second sidewall with the mounting member positioned therebetween, the mounting member disengages the element as it is moved away from the sidewall.

Another aspect of the present invention relates to a handgun holster wherein the first sidewall comprises an outer sidewall and the second sidewall comprises an inner sidewall adapted to be positioned adjacent the user's body and wherein the opening comprises a top opening defined between upper edge portions of the sidewalls and a forward slot defined between forward edge portions of the sidewalls. Thus, a handgun retained in the holster must be withdrawn in a generally forward direction through the front slot.

Yet another aspect of this invention relates to an elongated brace element disposed between the sidewalls including a first end portion defining a trigger guard overlying stop element partially closing the opening wherein a handgun disposed between the sidewalls is inhibited from being drawn directly upwardly. The brace element also includes a second end portion having an integral protruding muzzle end anchor including an elongated end portion extending generally toward the top opening and adapted to extend within a handgun muzzle wherein a handgun disposed between the sidewalls is inhibited not only from being rotated or pivoted within the holster, allowing the muzzle to be extended through the forward slot, but also from being drawn directly through the forward slot.

A further aspect of the present invention relates to inner and outer sidewalls which include respective raised portions defining a handgun receiving pocket including upper and lower portions for respectively receiving cylinder and barrel portions of a handgun. An adjusting means extends between the sidewalls adjacent the brace element and the lower pocket portion for adjustably biasing the sidewalls together and imparting an adjustable squeezing effect to a handgun carried by the pocket without materially affecting the positioning of the handgun with respect to the brace element and respective pocket portions.

Accordingly, it is a general object to provide an improved handgun holster.

Another general object is the provision of an improved handgun holster having retaining means selectively positionable by the wearer depending upon the conditions of use.

A specific object is the provision of a durable holster which is difficult to open by one other than the wearer while permitting the wearer to withdraw the handgun with simple, single hand movements while securely grasping the weapon.

Another object is to provide a holster with retaining means wherein a handgun may be secured against accidental displacement or unwanted removal from the holster.

A further object is the provision of a holster wherein a resilient handgun clamping or frictional force may be easily adjusted without altering both the position of the handgun in the holster and the ease with which a handgun may be withdrawn from the holster.

Other objects are to provide a simple holster construction economical in the manufacture and efficient in use and operation.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DESCRIPTION OF THE PREFERRED EMBODIMENT

Figure 1:
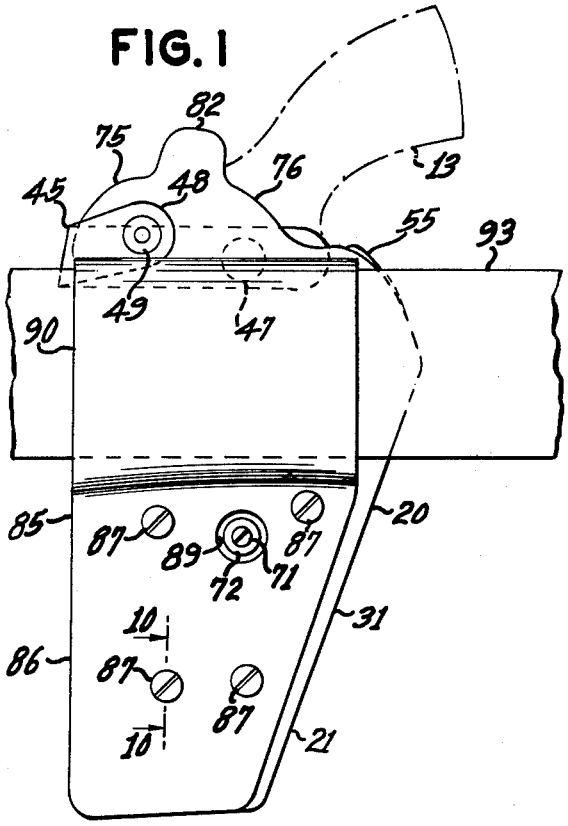
FIG. 1 is an inner side elevational view of the holster with a handgun, shown by broken lines, retained therein.

Referring now more particularly to the drawings, the holster 20 is designed to receive a handgun, illustrated by broken lines in FIGS. 1 through 4 and indicated in general by reference character 13. Handgun 13 generally includes handgrip 14, cylinder portion 15, hammer 16, trigger guard 17 and barrel portion 18 having an end portion or muzzle 19. Formed of a relatively rugged yet flexible material as shown by U.S. Pat. No. 3,902,639, the holster 20 generally comprises a body portion 21 including spaced first and second sidewalls 22,32 defining an opening 40 therebetween and an elongated element or strap 45 connected to the first sidewall 22, adapted to span the opening 40 and including an end portion 48 carrying a disengageable means in the form of a snap element 49 adapted to engage a disengageable means in the form of a snap element 50 attached to the second or inner sidewall 32. Holster 20 also comprises an operating means 75, movably mounted to the second sidewall 32 of holster body 21, including a finger portion 80 disposed generally adjacent snap element 50 and also mounting bracket 85 connected to second sidewall 32 for supporting the holster 20 from the waist or other portion of the wearer. When attached to the wearer, the second sidewall 32 will normally be positioned adjacent the body of the wearer and constitute the inner sidewall while the first sidewall 22, accordingly will be disposed outwardly of the wearer's body and constitute the outer sidewall of the holster.

Figure 2:
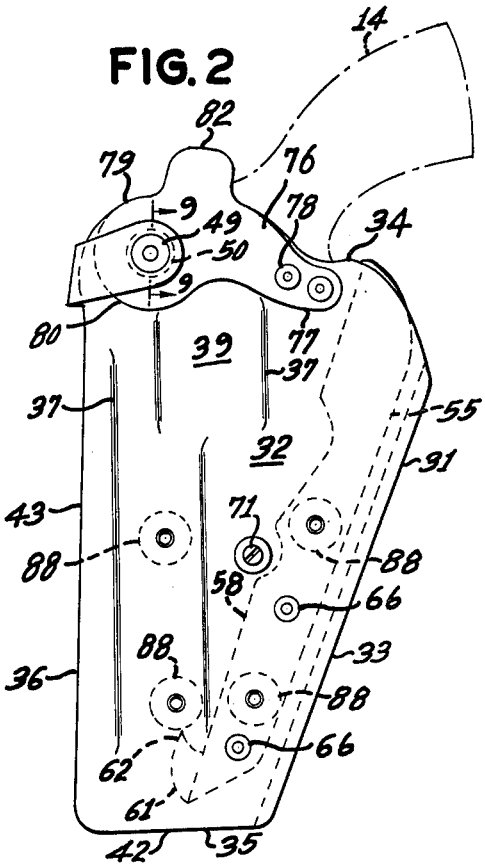
FIG. 2 is a view similar to FIG. 1 with the mounting bracket removed therefrom.
Figure 4:
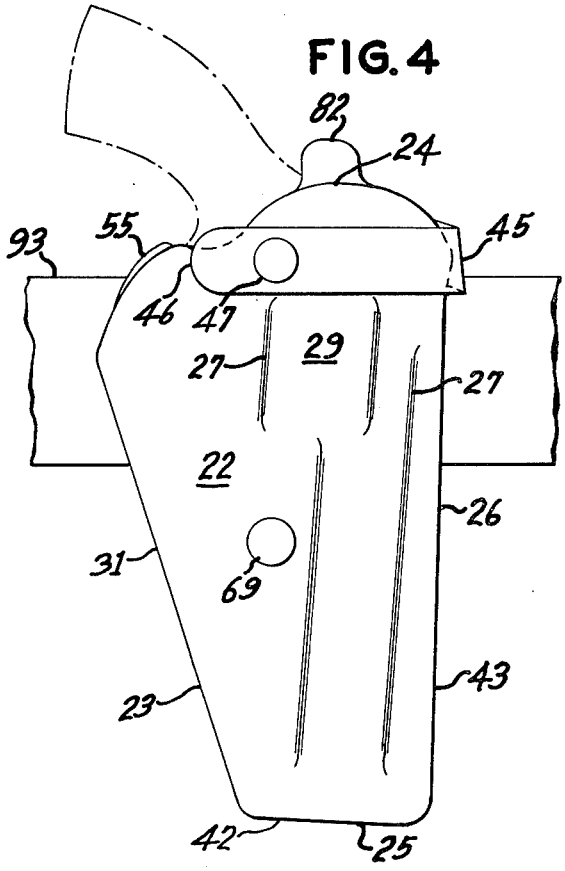
FIG. 4 is an outer side elevational view of the holster.
Figure 6:
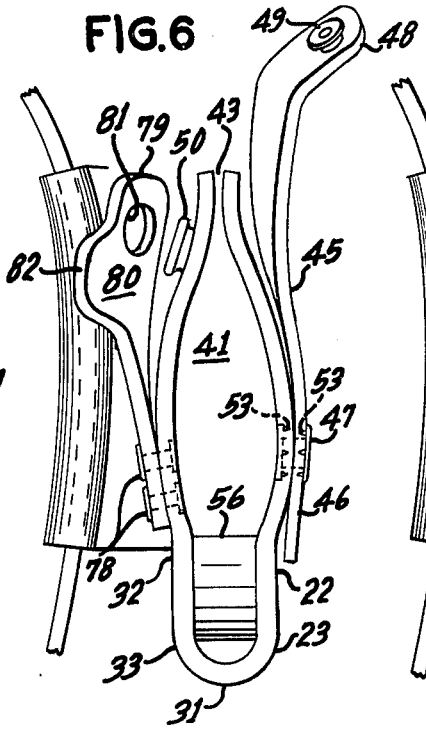
FIG. 6 is a view similar to FIG. 5 with the flap and strap moved away from the inner sidewall.

Joined or formed together along common respective rear edge portions 23,33, spaced sidewalls 22,32 include top edge portions 24,34 and relatively smaller bottom edge portions 25,35 as shown in FIGS. 2 and 4, wherein the opening 40 defined therebetween includes not only a top opening 41 and a bottom opening 42 but also a forward slot 43 defined between respective forward edge portions 26,36 of sidewalls 22,32. Thus, a rear edge portion 31 of the holster, which interconnects rear edge portions 23,33 of sidewalls 22,32, generally defines a linear hinge about which sidewalls 22,32 may be flexed outwardly as the handgun is withdrawn from the holster. Interior surfaces 28,38 of respective sidewalls 22,32 each include outwardly extending raised portions 27,37, generally depicted on exterior surfaces 29,39 of sidewalls 22,32 in FIGS. 2 and 4, which generally define a handgun pocket therebetween for respectively generally receiving handgun trigger, hammer and cylinder portions in an upper pocket portion and barrel and muzzle portions in a lower elongated pocket portion of the handgun receiving pocket. Further, as shown in FIG. 6, rear edge portions 23,33 are formed with a generally parallel relationship and, similarly, forward edge portions 26,36 are formed with a generally parallel relationship wherein the respective top edge portions 24,34 extending therebetween are outwardly curved to permit the handgun 13 to be easily withdrawn or inserted between sidewalls 22,32.

Figure 3:
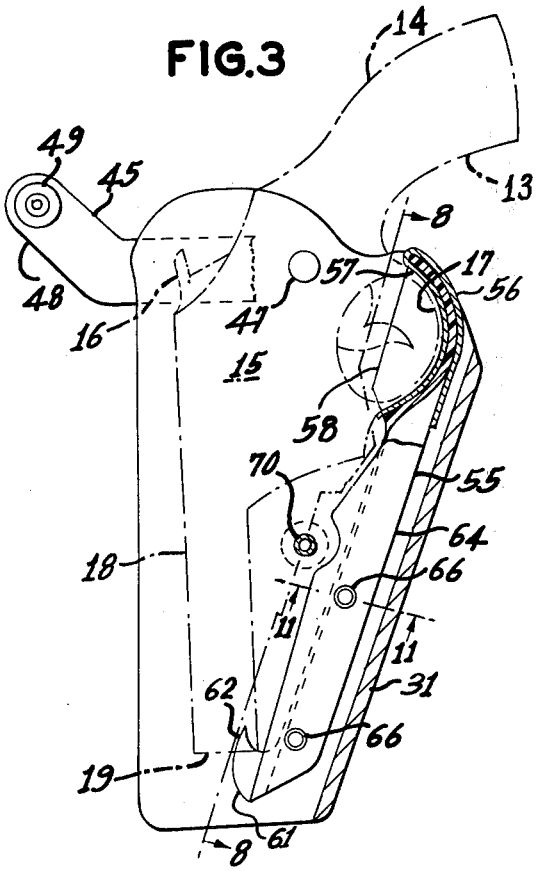
FIG. 3 is a cross-sectional view of FIG. 2 with the strap unsnapped and the brace element partially broken away.
Figure 11:
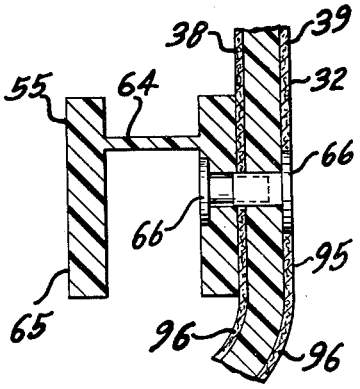
FIG. 11 is a sectional view along line 11—11 of FIG. 3.

An elongated rigid handgun brace element 55, generally depicted in FIGS. 2,3,8 and 11, is disposed between rear edge portions 23,33 of sidewalls 22,32 and includes a first end portion 56 defining a trigger guard overlying stop element, an opposite second end portion 60 having an integral protruding muzzle end anchor 61 and an intermediate portion 64. First end portion 56 includes a concave indentation surface 57, which may be covered with a soft material such as leather, adapted to generally abut adjacent portions of trigger guard 17 wherein the extremity of stop element 56 is preferably adapted to partially close top opening 41 and cover a rear portion of trigger guard 17, as shown in FIG. 3. Thus, to withdraw a handgun from the holster in a generally upward direction, an initial forward movement of the handgun is required such that trigger guard 17 clears stop element 56. Brace first end portion 56 also includes spaced parallel flange portions 58, as shown in FIG. 3 and in FIG. 8 where a section of trigger guard 17 is positioned therebetween, which not only extend on opposite sides of the trigger guard and thus stabilize the trigger guard against sideways deflection but the flange portions 58 also provide structural reinforcement for first end portion 56. Second end portion 60, also generally disclosed in FIG. 3 and in FIG. 8 where a section of muzzle 19 is attached thereto, includes an outwardly extending muzzle end anchor 61 having an elongated end portion 62 extending generally toward the top opening 41 and adapted to extend within a handgun muzzle to inhibit the direct withdrawal of a handgun muzzle in a forward direction through slot 43. Intermediate portion 64 may have an I-shaped cross-section, as shown in FIG. 11, including spaced reinforcing flanges 65 forming general continuations of flange portions 58.

Brace element 55 is secured in position between the rear edge portions 23,33 of sidewalls 22,32 with one or more connecting elements 66 which extend between one or both of sidewalls 22,32 and brace element 55. Preferably, as depicted in FIGS. 2,3,8 and 11, connecting elements 66 extend between inner sidewall 32 and brace element 55, thus permitting the outer sidewall 22 to move relative to the inner sidewall 32 about rear edge portion 31 of the holster 20. Accordingly, the brace element 55 and pocket portions, which are usually designed for a selected, particular gun configuration, form a handgun retaining means wherein both the clamping force exerted on the handgun 13 by the sidewalls 22,32 and the degree of closure of forward slot 43 may be adjusted without materially affecting the positioning of the handgun with respect to brace element 55 and the holster pocket portions. Extending between sidewalls 22,32 and disposed adjacent intermediate portion 64 of brace element 55 and generally adjacent lower regions of raised portions 27,37 of sidewalls 22,32 in an adjusting means 69 in the form of screw elements 70 and 71, shown in FIGS. 1 through 4 and more particularly in FIG. 8. Adjusting means 69, which helps to adjustably bias sidewalls 22,32 together and imparts an adjustable squeezing effect to a handgun carried by the holster pocket regions, is disposed generally centrally between respective top edge 24,34 and bottom edge 25,35 portions of sidewalls 22,32, thus permitting an adjustable balanced clamping force to be applied to the handgun 13. Adjusting means 69 also includes a rubber cushion 73 disposed between a metal washer 72, which is carried by screw element 71, and exterior surface 39 of inner sidewall 32; such cushion 73 being compressible and allowing the sidewalls 22 and 32 to flex away from each other as the handgun is withdrawn and/or reinserted in the holster 20. Accordingly, the features of spaced resiliently biased sidewalls 22,32 joined of formed together along the holster rear edge portion 31, which generally defines a linear hinge, and the resilient adjusting means 69, which permits the sidewalls to deflect outwardly as cushion 73 is compressed, permits the handgun 13 to be withdrawn relatively easily through forward slot 43 while still positively retaining the handgun 13 when it is normally disposed in holster 20.

Elongated element or strap 45 includes a first end portion 46 attached by connecting element 47 to the outer sidewall 22, generally adjacent to and rearwardly of raised portion 27. As shown in FIG. 6, connecting element 47 includes depending prong portions 53 which are of similar construction as prong portions 51 of snap elements 49 and 50 and prong portions 98 of connecting element 88. Thus, when the prong portions 53 are properly embedded in respective interior and exterior surfaces 28 and 29 of sidewall 22, the first end portion 46 of strap 45 will be maintained in a non-rotatable position.

Also, the portion of connecting element 47 attached to outer sidewall 22 is designed to have the outward appearance of a snap engageable element such that a person unfamiliar with the operation of the holster, such as an assailant, would ordinarily attempt to remove the handgun by pulling on strap end portion 46 to dislodge connecting element 47. Thus, connecting element 47 also functions as an inoperative decoy which provides an additional measure of protection for the wearer against an assailant. Further, the strap 45 is adapted to span the opening 40, perferably the upper portion of forward slot 43, and includes an offset second end portion 48, as shown in FIG. 3, carrying a disengageable means in the form of a snap means or snap element 49 adapted to be releasably connected to an inner sidewall disengageable means in the form of snap element 50. As shown in FIG. 1, strap 45 is attached in a generally horizontal position on holster 20 and due to connection element 47 being positioned somewhat below snap element 50, strap second end portion 48 is angularly offset to permit snap elements 49 and 50 to engage. As further depicted in FIGS. 1,2,6,7, and more particularly in FIG. 9, snap element 50 is secured to inner sidewall 32 adjacent top edge portion 34 and forward edge portion 36. Thus, when strap 45 generally spans the upper portion of forward slot 43 and is connected to sidewalls 22 and 32, the handgun is generally positively retained between the sidewalls 22,32 in cooperative relationship with the trigger guard stop 56 and muzzle anchor 61 of brace element 55. Although snap means such as those depicted by snap elements 49 and 50 are preferably utilized with holster 20, other forms of releasable connectors having disengageable shoulder portions may be employed without materially affecting such handgun withdrawal.

Holster 20 also includes an operating means 75 positionable for alternatively either encouraging the disengagment of snap elements 49 and 50 or, conversely, inhibiting the unwanted, inadvertent disengagement of snap elements 49 and 50. Generally, operating means 75 comprises an elongated flap or mounting member 76 mounted to the top edge portion 34 of inner sidewall 32, wherein flap rear end portion 77 is attached adjacent rear edge portion 33 with rivet elements 78. Resilient flap 76 is generally shaped to follow the contour of the adjacent exterior surface portions of sidewall 32 wherein front end portion 79, which is located adjacent forward slot 43 and top edge portion 34, is biased inwardly toward inner sidewall 32. As shown in FIGS. 2 and 6, strap end portion 48 includes one or more finger portions 80 disposed adjacent snap element 50 and, preferably, the finger portions 80 completely encircle the adjacent snap element 50 and generally define a passageway 81 extending through flap front end portion 79. As further depicted in FIGS. 5 and 7, strap second end portion 48 is selectively disposable so as to be on respective opposite sides of finger portions 80 of flap front end portion 79 when the strap 45 spans forward slot 43 and is disposed to engage its snap element 49 with snap element 50. Operating means 75 also includes a manually engageable tab 82, extending beyond the top edge portion 34 of inner sidewall 32 and adapted to be engaged by the wearer for moving the finger portions 80 of front end portion 79 away from the second sidewall 32.

Figure 5:
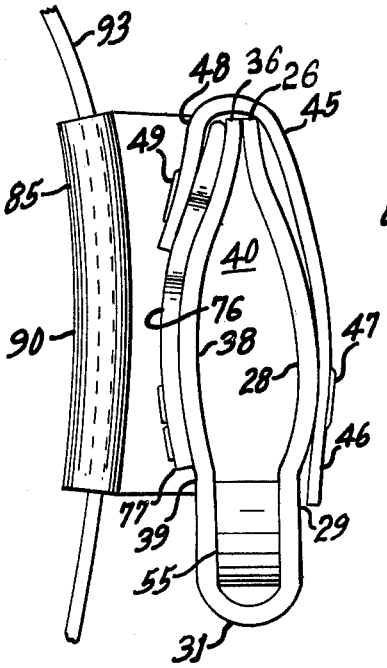
FIG. 5 is a top view of the holster with the strap connected to the inner sidewall and the flap disposed therebetween, showing the normal operative position of the retaining elements.
Figure 7:
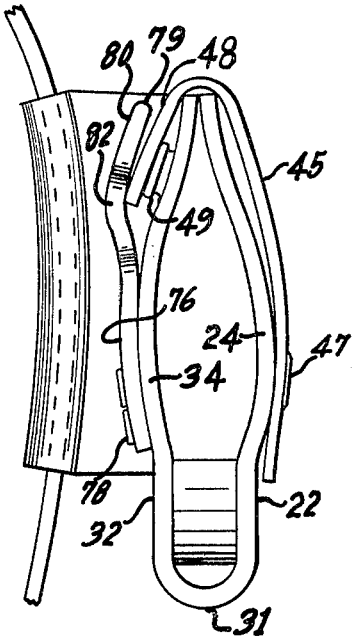
FIG. 7 is a top view of the holster with the strap spanning a forward slot and connected to the inner sidewall and underlying the flap, showing the most secure position of the retaining elements.
Figure 8:
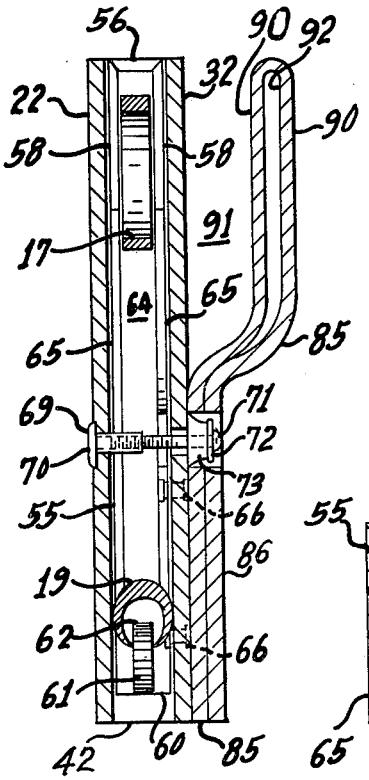
FIG. 8 is a sectional view along line 8—8 of FIG. 3.
Figure 9:
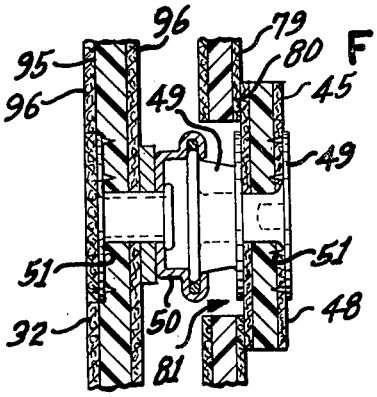
FIG. 9 is a sectional view along line 9—9 of FIG. 2.

FIGS. 5 and 9 generally illustrate the operative position wherein snap element 49 extends through passageway 81 and engages snap element 50 with finger portions 80 disposed between strap second end portion 48 and inner sidewall 32. Accordingly, for the wearer of the holster 20 to withdraw the handgun 14, end portion 79 and tab 82 are moved away from inner sidewall 32 resulting in the disengagement of snap elements 49 and 50. As a result of the leverage exerted on snap elements 49, 50 by tab 82 and finger portions 80 as well as the relative position of tab 82, the tab may be operated relatively easily, such as with the thumb of the hand, while permitting a natural, efficient and fast withdrawal of the handgun from the holster with said same hand. FIG. 7 illustrates the alternative operative position wherein strap end portion 48 is disposed between inner sidewall 32 and finger portions 80 of flap front end portion 79 when snap elements 49 and 50 are engaged. Finger portions 80, which are biased inwardly toward inner sidewall 32, inhibit inadvertent disengagment of snap elements 49 and 50 and, consequently, the flap front end portion 79 must be moved away from inner sidewall 32 while the snap elements 49 and 50 are being disengaged. Normally this requires the use and cooperation of both hands, although such operative movements may be accomplished by using one hand only with relatively greater difficulty and requiring considerably more time. Thus, the operative condition illustrated in FIG. 6 is well adapted for conditions, such as crowd control situations, wherein another person may unexpectedly attempt to snatch or otherwise remove the handgun 13 from holster 20.

A mounting bracket 85 including a lower bracket portion 86 and an upper portion 90 is connected to the inner sidewall 32 for supporting the holster 20 from the body of the wearer. Lower bracket portion 86 generally conforms to the contour of inner sidewall 32 and is connected thereto with threaded male connecting elements 87 which are received in threaded female connecting elements 88 generally embedded in inner sidewall 32. Lower bracket portion 86 also includes a passage 89 for permitting the compression of resilient rubber cushion 73 and allowing direct access to screw element 71. Upper bracket portion 90 extends outwardly from inner sidewall 32 and generally defines a clearing space 91 therebetween, permitting the flap front end portion 79 to be flexed away from inner sidewall 32. Additionally, a loop 92 is formed between spaced wall portions of upper bracket portion 90 for receiving a belt 93 or the like fastening element secured to the wearer.

Figure 10:
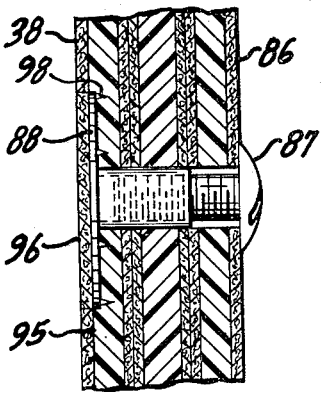
FIG. 10 is a sectional view along line 10—10 of FIG. 1.

Preferably, the various metallic fasteners and inserts embedded in the holster body 21 and particularly portions thereof which would normally be exposed to contact with the handgun 13 are covered with leather, cloth, or other protective covering to preclude damage of the handgun 13. Also, the holster is preferably formed with a central core 95 of plastic or another durable and resilient material provided with a covering 96 of leather or the like over the inside and outside of the holster core, as illustrated in FIGS. 9,10 and 11.

In the use of the holster 20 embodying the invention, the handgun 13 is inserted into the holster 20 by initially moving muzzle 19 and barrel portion 18 of the handgun 13 through the forward slot 43 or top opening 41 and placing the muzzle 19 so that it generally engages muzzle end anchor 61 with elongated end portion 62 extending therein. Thereafter, handgrip 14, cylinder 15 and hammer 16 portions of handgun 13 are moved rearwardly toward rear edge portion 31 until trigger guard 17 is generally disposed in abutting relationship with concave indentation 57 and the handgun 13 is generally positioned in the handgun receiving pocket defined between outwardly extending indentations or raised portions 27,37. In moving the upper portion of the handgun into holster 20, resilient and generally inwardly biased sidewalls 22,32 are readily separated or flexed apart, permitting the handgun to be positioned therein. After being so positioned, the handgun 13 will be retained in holster 20 against direct upward displacement by the curved portion 57 which generally engages trigger guard 17 and thereby cooperatively maitains muzzle 19 in engagement with muzzle end anchor 61. Additionally, the resilient nature of the contoured sidewalls 22,32 and the adjustable resilient clamping force exerted on the handgun 13 through adjusting means 69 releasably maintains the rear portion of handgun trigger guard 17 in engagement with curved portion 57 and generally positions the handgun against horizontal displacement. However, although sufficient adjustable clamping force is provided to retain handgun 13 between sidewalls 22,32, the selectively adjustable clamping force which the wearer must overcome in withdrawing the handgun is generally not excessive and allows the handgun to be rapidly and easily withdrawn. For example, to remove handgun 13 from holster 20, the wearer normally moves the rear portion of the handgun, more specifically trigger guard 17, forwardly in the holster thereby clearing trigger guard stop 56, generally defined by indentation 57, and thereafter permitting the handgun to be displaced upwardly to clear end portion 62 of muzzle end achor 61 whereupon the handgun may be completely withdrawn from the holster.

As aforementioned, with strap 45 spanning forward slot 43 and snap elements 49 and 50 engaged, handgun 13 is normally positively retained in holster 20. If strap 45 is positioned as depicted in FIG. 5, handgun 13 is normally withdrawn by positioning the hand adjacent handgrip 14 and the thumb in contact with tab 82 and subsequently grasping the handgrip 14 while the tab 82 is pressed outwardly to disengage snap elements 49 and 50. Thereafter, the handgun is carried forwardly to clear trigger guard stop 56 and withdrawn from holster 20 through top opening 41 and forward slot 43 by generally employing a single yet efficient arm motion. Correspondingly, when strap 45 is positioned as depicted in FIG. 7, the handgun is normally removed from the holster by pressing tab 82 away from sidewall 32 with one hand while the other hand pulls on strap end portion 48 to disengage snap elements 49 and 50. Subsequently, the handgun is withdrawn from the holster in the aforementioned manner.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In a handgun holster comprising a body including spaced outer and inner sidewalls having outer surfaces and defining an opening therebetween, an elongated element spanning said opening and including one end portion connected to said outer sidewall and a second end portion, a pair of cooperating snap elements, one of said snap elements being attached to said inner sidewall and the other of said snap elements being carried by said second end portion, and operating means movably mounted to said inner sidewall comprising a manually engageable flap projecting upwardly from said inner sidewall and a finger portion integral with said flap, said flap having a passageway therethrough with said passageway being capable of surrounding said engaged snap elements, said finger portion being disposed adjacent said one snap element and between said outer surface of said inner sidewall and said elongated element when said snap elements are engaged, said finger portion when so disposed may be engaged to move inwardly toward the wearer of the holster and cause said snap elements to become disengaged thereby releasing said elongated element whereby a handgun in the holster may be withdrawn through said opening.

2. The combination according to claim 1, further comprising an elongated rigid brace element disposed between said sidewalls, including a first end portion defining a trigger guard overlying stop element and an opposite second end portion having an integral protruding muzzle end anchor.

3. The combination according to claim 1, wherein said opening comprises a top opening defined between upper edge portions of said sidewalls and a slot defined between forward edge portions of said sidewalls.

4. The combination according to claim 3, wherein said body includes an upper end portion and a lower end portion and further comprising a muzzle end anchor disposed between said sidewalls generally adjacent said lower end portion, said anchor including an elongated end portion extending generally toward said top opening.

5. The combination according to claim 1, wheren said inner sidewall includes forward and rear edge portions and said finger portion is disposed generally between said one snap element and said rear edge portion of said inner sidewall and connected thereto generally medially thereof.

6. In a handgun holster comprising a body including spaced outer and inner sidewalls defining an opening therebetween, shoulder means fixed to said inner sidewall, an elongated element connected to said outer sidewall and including an end portion having a shoulder, said shoulder of said end portion of said element being engageable with said shoulder means when said element is positioned to span said opening, a finger portion disposed adjacent said shoulder means and moveable with respect to said inner sidewall, a resilient mounting member connected to said body for mounting and biasing said finger portion toward said inner sidewall, said finger portion capable of being disposed in several positions, one position thereof being between said inner sidewall and said end portion when said shoulder and said shoulder means are engaged, and said mounting member having a tab for moving said finger portion inwardly away from said inner sidewall, said finger having a passageway therethrough with said passageway being capable of surrounding said engaged shoulder and shoulder means, said finger portion when disposed in said one position may be moved inwardly of said inner sidewall and moves said shoulder of said end portion of said element away from said shoulder means to cause disengagement therebetween therealong releasing said element whereby a handgun in the holster may be withdrawn through said opening.

7. The combination according to claim 6, further comprising a mounting bracket connected to said inner sidewall and extending outwardly therefrom, and a clearing space defined between said mounting bracket and said inner sidewall, said finger portion being disposed within said clearing space.

8. The combination according to claim 6, further comprising an elongated brace element disposed between said sidewalls including a first end portion including a trigger guard overlying stop element and a second end portion including muzzle end anchor means adapted to extend generally within a handgun muzzle.

9. The combination according to claim 6 wherein said finger portion is disposable in another of said positions and with said inner sidewall sandwiching therebetween said end portion of said element when said shoulder and said shoulder means are engaged so that movement of said finger portion does not cause disengagement of said shoulder and said shoulder means whereby a handgun in the holster remains secured therein until a disengaging force is applied to said end portion to disengage said shoulder from said shoulder means.

10. In a handgun holster comprising a body including spaced outer and inner sidewalls having an opening defined therebetween and through which a handgun is removable, shoulder means fixed to said inner sidewall, a strap element connected to said outer sidewall adapted to span said opening and including an end portion remote from said outer sidewall, said end portion being provided with a shoulder engageable with said shoulder means when said strap element is positioned to span said opening, a finger disposed adjacent said shoulder means, and means for swingably mounting said finger to said body for swinging with respect to said inner sidewall, said end portion being selectively disposable so as to be on respective opposite sides of said finger when said strap element is so disposed to engage said shoulder with said shoulder means, said finger either overlying said end portion to render the engagement between said shoulder and shoulder means secure, or said finger being sandwiched between said end portion and said inner sidewall to permit said finger to move inwardly to release said shoulder and shoulder means and thus said strap element whereby a handgun may be withdrawn through said opening.

11. The combination according to claim 10, wherein said inner sidewall includes a forward, rear and top edge portions, said means for swingably mounting comprises an elongated flap having one end portion connected to said inner sidewall adjacent said top edge portion and generally medially between said forward and rear edge portions and the other flap end portion being disposed adjacent said forward and top edge portions with said other end portion being biased toward said inner sidewall.

12. The combination according to claim 11, wherein said finger is integral with said flap and extending above said top edge portion of said inner sidewall generally adjacent said shoulder means.

* * * * *